US010087695B1

(12) United States Patent
Woods

(10) Patent No.: US 10,087,695 B1
(45) Date of Patent: Oct. 2, 2018

(54) DOWNHOLE SAFETY VALVE AND METHOD OF APPLICATION

(71) Applicant: NOEP, LLC, Wellsville, OH (US)

(72) Inventor: Joshua Slade Woods, Wellsville, OH (US)

(73) Assignee: TEXAS OILWELL PARTNERS, Spring, TX (US)

( * ) Notice: Subject to any disclaimer, the term of this patent is extended or adjusted under 35 U.S.C. 154(b) by 0 days.

(21) Appl. No.: 15/901,381

(22) Filed: Feb. 21, 2018

(51) Int. Cl.

| | |
|---|---|
| ***E21B 23/14*** | (2006.01) |
| ***E21B 23/02*** | (2006.01) |
| *E21B 34/10* | (2006.01) |
| *E21B 34/16* | (2006.01) |
| *E21B 34/06* | (2006.01) |
| *E21B 23/03* | (2006.01) |
| *E21B 34/00* | (2006.01) |

(52) U.S. Cl.
CPC ..... *E21B 23/14* (2013.01); *E21B 23/02* (2013.01); *E21B 23/03* (2013.01); *E21B 34/063* (2013.01); *E21B 34/102* (2013.01); *E21B 34/16* (2013.01); *E21B 2034/002* (2013.01); *E21B 2034/005* (2013.01)

(58) Field of Classification Search
CPC ..... E21B 23/02; E21B 34/14
See application file for complete search history.

(56) References Cited

U.S. PATENT DOCUMENTS

| | | | | |
|---|---|---|---|---|
| 2,771,141 | A | 9/1953 | Farral | |
| 3,845,815 | A | 11/1974 | Garwood | |
| 4,776,410 | A | 10/1988 | Perkin | |
| 4,942,925 | A | 7/1990 | Themig | |
| 8,151,910 | B2 | 4/2012 | Swinford | |
| 9,038,744 | B2 | 5/2015 | Swinford | |
| 2011/0067862 | A1* | 3/2011 | Clem | E21B 34/14 166/278 |

* cited by examiner

*Primary Examiner* — Giovanna C Wright
*Assistant Examiner* — Kristyn A Hall
(74) *Attorney, Agent, or Firm* — Eric P. Mirabel

(57) ABSTRACT

Disclosed is a cost-effective remedy to loss of well control caused by a defective string section upstream of the BHA, and more cost-effective inspection, maintenance, repair and replacement of any tools placed upstream of the BHA. The solution is to deploy one or more tools along the length of the string, either: (i) each tool below a profile nipple, and where each tool is upstream from an adjacent downhole safety valve ("DSV"); or (ii) one or more Flapper-tool-DSV combinations each below a profile nipple, and where the tool is positioned between each Flapper and DSV in the combination. If desired, the valving system described may be deployed along the string without a tool, to allow section-by-section inspection, maintenance, repair and replacement of string sections.

20 Claims, 8 Drawing Sheets

DOWNHOLE SAFETY VALVE AND METHOD OF APPLICATION

BACKGROUND

Conventionally, tools used in oil and gas drilling, particularly jarring devices ("jars" see e.g. U.S. Pat. Nos. 9,038,744; 8,151,910, respectively entitled: "Jet Hammer" and "Drilling Jar," both incorporated by reference) were part of the bottomhole assembly (BHA). The BHA is at the lower-end of a drill-string (which is generically referred to as a work string, including both coil tubing and pipe strings; or, generically referred to as a "string" herein). The BHA consists of (from the bottom up in a vertical well) the drill bit, the drill bit sub, optionally, a mud motor (used for driving of the bit hydraulically without rotating the work string), as well as stabilizers, which keep the assembly centered in the hole, a drill collar (heavy, thick-walled tubes used to apply weight to the drill bit) and preferably jars and, as needed, crossovers (adaptors) for fitting together different threadforms on the various components.

Directional drilling is now commonplace, and allows turning a vertical drill string and boring horizontally, or at any angle between horizontal and vertical. Some wells now extend over 10 km from the surface start location, but at a true vertical depth of only 1,600-2,600 m. With directional drilling, and with very deep wells, it's often preferable to place jars at intervals along the string, as well as at the BHA. During drilling of such wells, the drill-string often sticks, and needs to be jarred loose. Other tools may also be preferably placed along the drill string, e.g., shock absorbing tools to aid in stabilizing the bits during drilling; especially useful for rotary drilling (see e.g., U.S. Pat. No. 4,776,410 "Stabilizing tool for well drilling" incorporated by reference). Well bore cleaning tools may also be desired for placement along the string (e.g., U.S. Pat. No. 2,771,141 "Jet Wall Cleaner,") as well as logging tools (e.g., U.S. Pat. No. 3,638,484), fluid bypass tools (e.g., U.S. Pat. No. 3,845,815) and extended reach tools (e.g U.S. Pat. No. 6,467,557) (all patents incorporated by reference).

During drilling loss of well control is commonplace: due, most frequently, to breaches in the drill string, including "twist-offs"—damage from torsion during drilling. The common means for providing the string a section-by-section system of well control is to use plugs, which are pumped down from the surface and arrested and set by the first nipple profile they encounter in the string. See e.g., U.S. Pat. No. 4,942,925, incorporated by reference. An impediment to placement of tools along the string is that tools generally have a smaller inner diameter than the drill pipe or the outer diameter of a plug. Plugs cannot be pumped past a tool. Therefore, tools are preferably used only at or near the BHA, and not along the string—though they may be needed upstream as well.

Conventionally, where tools are deployed along a string (and because plugs cannot pass them to profile nipples) in order to remedy a loss of well control, repair a damaged or non-functioning tool, or maintain the tool or the string, a wire line is run down from the surface to set a plug in a profile nipple near the BHA. From there, the entire string must be "tripped"—the drill string is pulled up in relatively short sections, each of which are disconnected in sequence, and then stacked, preferably vertically in a rack. After the repair or maintenance, the stacked string sections must be "tripped in." The tripping of lengthy strings is itself a time-consuming and expensive process, and the process also requires a wire line specialist, and a difficult connection of the wire line with a potentially very distant profile nipple (at the BHA).

Accordingly, there is a need for a simple, cost-effective method of regaining well control, or repairing, replacing or maintaining the string or any tools which are deployed along the string, which can avoid tripping and/or running down a wire-line in the event of problems upstream of the BHA.

SUMMARY

The invention provides, in a string where tools are deployed at positions upstream of the BHA, a more cost-effective remedy to loss of well control caused by a defective string section upstream of the BHA, and more cost-effective inspection, maintenance, repair and replacement of the tools placed upstream of the BHA. Even if tools are deployed at the BHA and not elsewhere along the string, the invention can be used to provide more efficient inspection, maintenance, repair and replacement of string sections upstream of the BHA.

The solution is to deploy the valving system described herein along the string, and with all tools placed along the length of the string. In the invention, one deploys with each tool, either: (i) below a profile nipple, and where each tool is upstream from an adjacent downhole safety valve ("DSV"); or (ii) one or more Flapper-tool-DSV combinations each below a profile nipple, and where the tool is positioned between each Flapper and DSV. A "Flapper" as used herein is a valve which can be closed from the surface by pumping down a ball (or other object) to spring the valve shut, after a component holding it open is pushed past the valve by the ball. Such Flappers include, for example: the "Drill Pipe Float Valve" Model G, Flapper Type, by Keystone Energy Tools, LLC (New Iberia, La.). A "DSV" is a valve which can be readily closed and opened once it is at the surface, but generally cannot be operated downhole. The preferred DSV has more than one valve, for added safety. Among the preferred DSV valves are key-controlled ball valves.

In the event of well control loss, or needed inspection, maintenance, replacement or repair of the string or of any tools, one either: (i) pumps a plug down to the first nipple profile (if deployed along the string); or (ii) pumps a ball down the string to shift a flow tube running the axial length of the Flapper, such that the flow tube is forced past the flapper valve, which springs shut when pumping ceases. After regaining control, one pulls the string up to the section where the plug or the Flapper is positioned; closes the associated DSV valve(s); bleeds pressure below the Flapper or plug (and removes the plug, if present). Then one can inspect or maintain the exposed string and tools, or replace or repair faulty string sections and tools. If there are no additional string sections or tools further downhole which need inspection, maintenance, replacement or repair, one re-inserts the sections of the string which were removed and continues operations. If there are additional problems further down, one opens the DSV valves and pumps down another plug or ball to the next profile nipple or Flapper, respectively, and repeats the process.

One or more Flapper-DSV combinations, or profile nipple-DSV combinations, can also be deployed at points along the string, to allow inspection, maintenance, replacement or repair of string sections upstream from the BHA without running a wire line or tripping.

The invention therefore allows section-by-section removal, and section-by-section inspection, maintenance, repair or replacement or of the string and the tools; instead of using a wire line to set a plug before tripping the string. The invention is described and exemplified further below and in the figures.

DETAILED DESCRIPTION

Figure 1A:
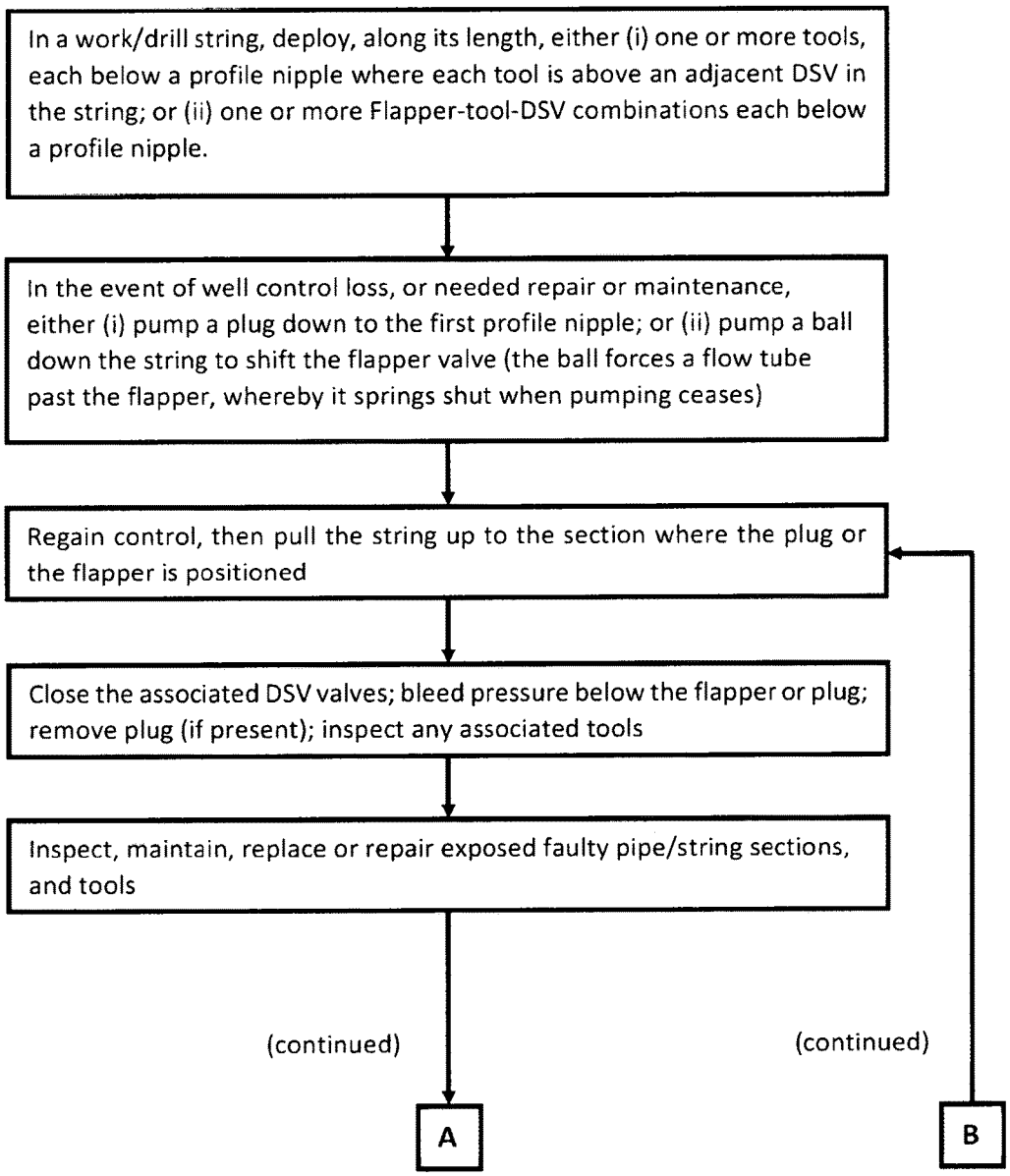
FIGS. 1A, 1B show a flow chart with the steps involved in removing, inspecting, repairing, replacing or maintaining the string and tools along the string.
Figure 3A:
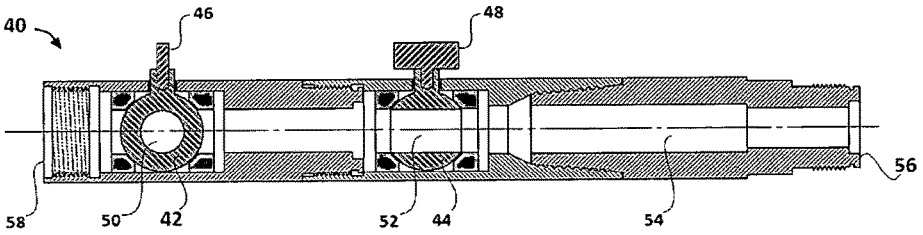
FIG. 3A shows the assembled DSV, with an upper sub (valve closed), center sub (valve open), and lower adapter sub.
Figure 3B:
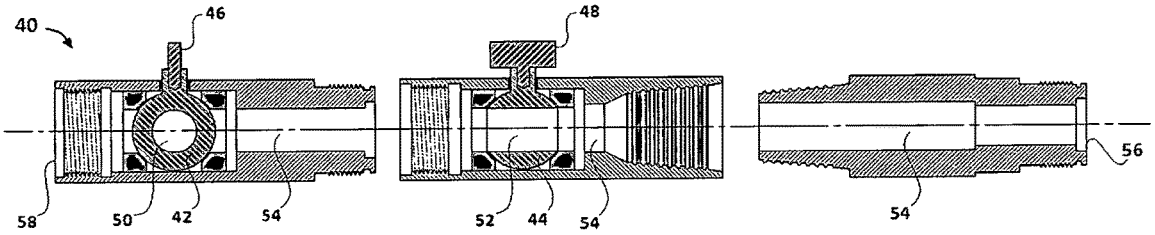
FIG. 3B is an exploded view of the components in FIG. 3A.
Figure 4:
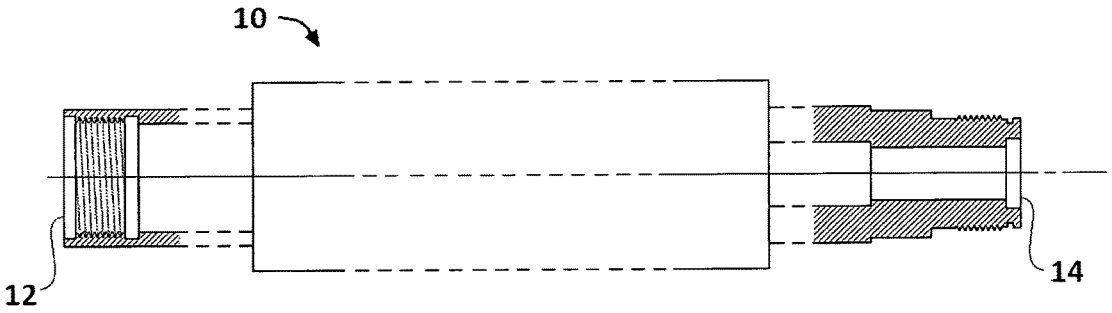
FIG. 4 depicts a tool and focuses on the upper and lower ends of a tool, which respectively attach to the lower end of the flapper valve assembly and the upper end of the DSV.

Referring to FIG. 1A, one preferably deploys one or more Flapper-tool-DSV combinations, with each preferably below a profile nipple, and where a tool 10 (as depicted in FIG. 4) is between each Flapper and DSV. When positioned in the string: the upper end 12 of tool 10 is joined (preferably by threading through adapters) onto the lower end 21 of flapper assembly 20 in FIGS. 2B and 2C; and the lower end 14 of tool 10 is threaded into the upper end 58 of DSV 40 in FIG. 3A. Unlike the position of upper valve 42 in FIGS. 3A and 3B, this valve 42, and valve 44, are open when DSV 40 is in position in the string during operations.

As noted in FIG. 1A, flapper assembly 20 is optional; one can rely on a profile nipple-plug with the tool 10 and DSV instead. One may also wish to deploy DSVs (associated with either a profile nipple-plug or flapper assembly 20) along the string, without an associated tool 10. If there is no tool 10 present, end 21 of flapper assembly 20 is joined directly to end 58 of DSV 40; or, if there is no tool 10 and a profile nipple-plug instead of flapper assembly 20, the upper portion of the string is threaded into end 58, and the lower portion of the string is threaded onto end 56 of DSV 40.

Figure 5A:
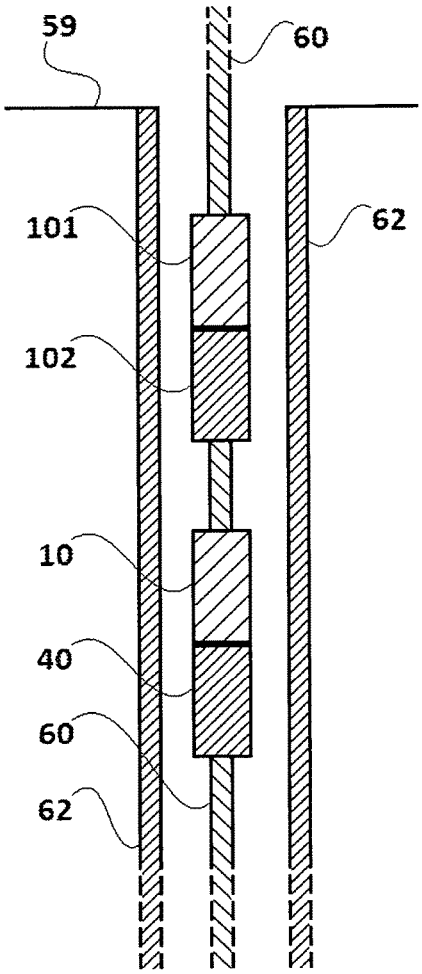
FIG. 5A depicts a string where a tool is positioned below a profile nipple, with a plug in place in the profile nipple, and where the tool is above a DSV in the string.
Figure 5B:
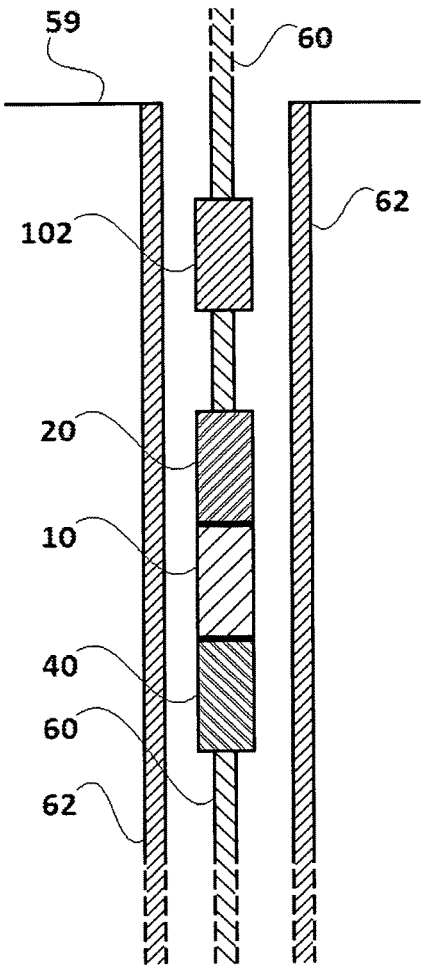
FIG. 5B depicts a flapper-tool-DSV combination below a profile nipple in a string.

FIG. 5A shows a string 60 (which may be coil tubing or a pipe string) extending down well bore 62 from the earth's surface 59, where a tool 10 (which may be a jar, a shock absorbing tool, a well bore cleaning tool, a logging tool, a fluid bypass tool or an extended reach tool) is positioned below a profile nipple 102, with a plug 101 in place in profile nipple 102, and where tool 10 is above a DSV 40 in string 60. FIG. 5B shows string 60 where a combination (top to bottom) of a flapper 20, tool 10 and DSV 40, is positioned in string 60 below a profile nipple 102.

In any alternative, including when one is using profile nipple-plug instead of flapper assembly 20, and with or without an associated tool 10, the one or more DSVs 40 set along the string are each below an associated profile nipple.

Referring to FIGS. 3A and 3B, valves 42 and 44 are opened and closed by turning respective keys 46 and 48, one-quarter turn. Such a movement of the keys 46, 48, changes positions of the center bores 50, 52 of valves 42, 44, from either alignment with the axial bore 54 of DSV 40 (open, like valve 44), or transverse to axial bore 54 (closed, like valve 42). The lower end 56 of DSV 40 is threaded to a mating sub on the upper end of the string (not shown).

Figure 2A:
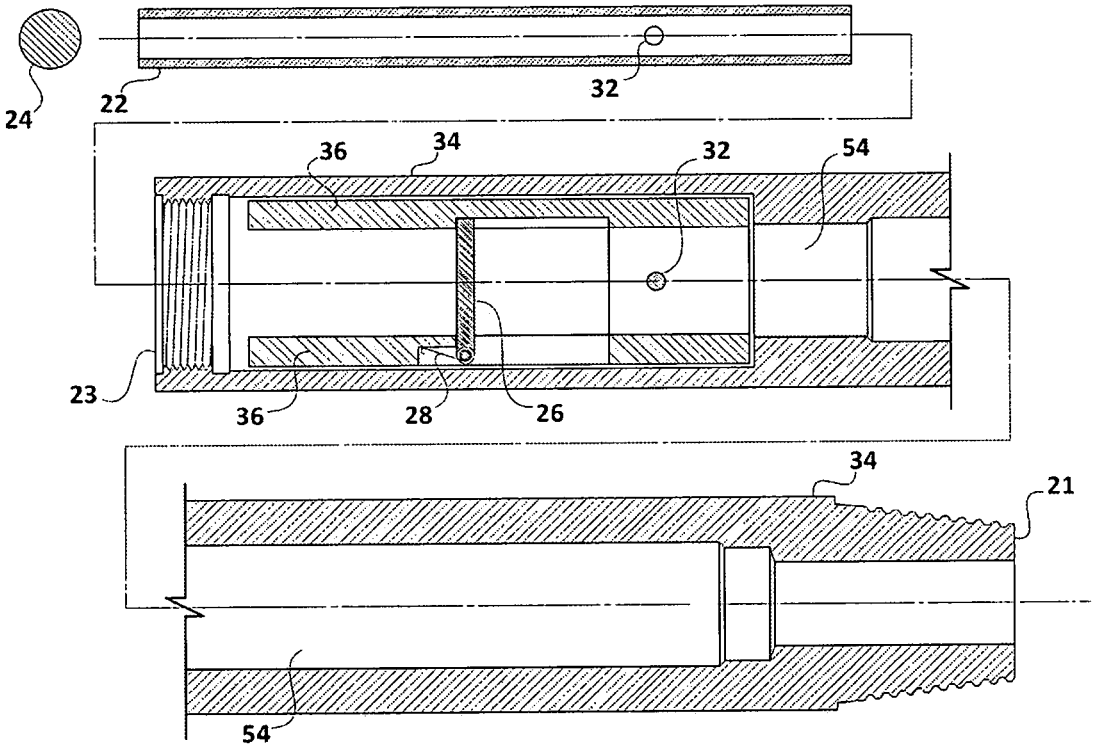
FIG. 2A is an exploded view of the flow tube, a ball, and the flapper valve assembly, showing the flapper valve closed.
Figure 2B:
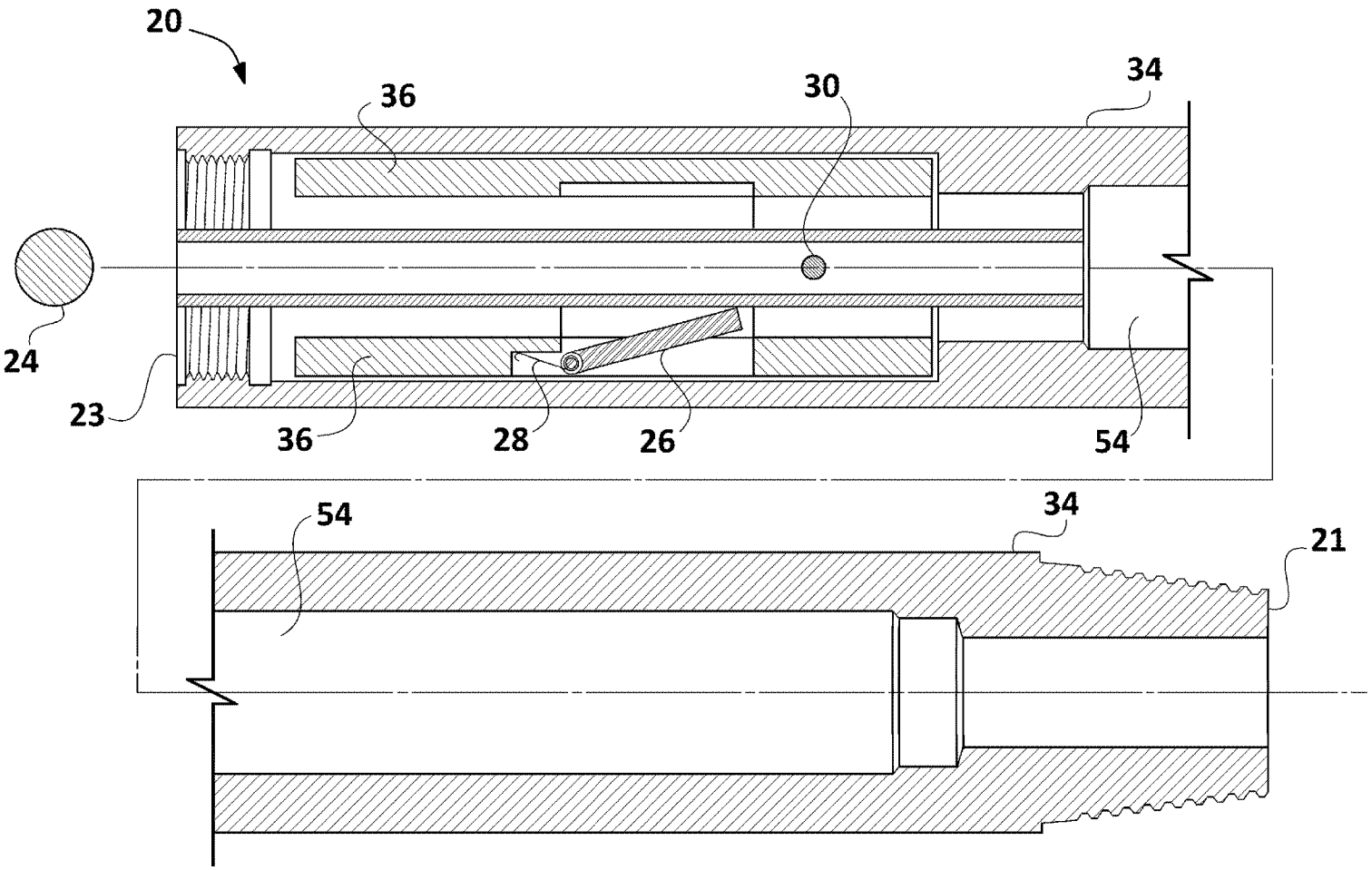
FIG. 2B is a partially exploded view showing the ball outside the flapper valve assembly, with the flow tube in place holding the flapper valve open.
Figure 2C:
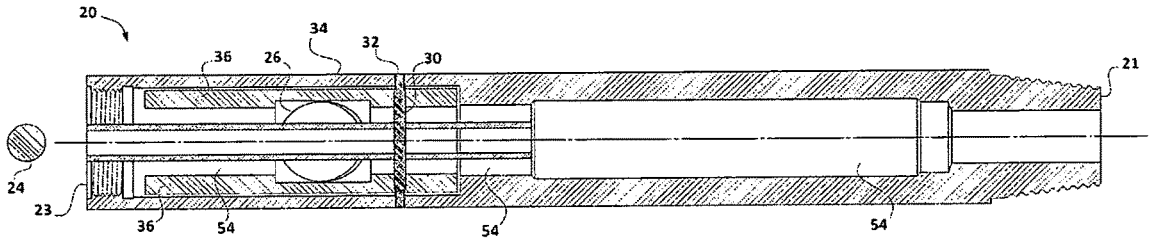
FIG. 2C is the same view as FIG. 2B but with the flapper valve assembly rotated one-quarter turn.
Figure 2D:
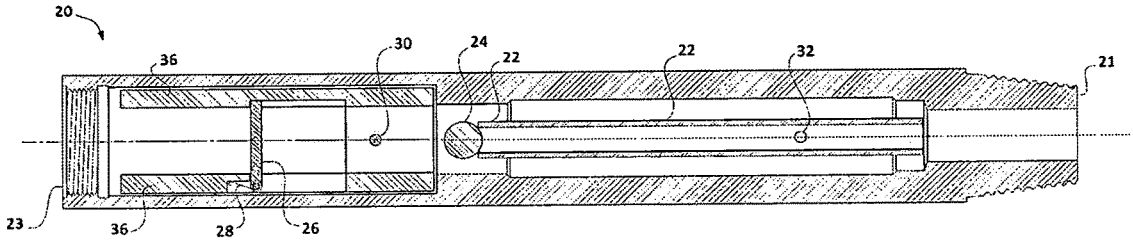
FIG. 2D shows the position of the flapper valve assembly after the ball has been pumped down to shift the flow tube past the flapper valve, and it has sprung shut.

In the event of loss of well control, or if one needs to inspect, maintain, repair or replace a section of the string or tool 10, one attaches a Kelly hose (at the surface) to the string, and either: (i) pumps a plug down to the uppermost nipple profile in the string (if there is no flapper assembly 20) to set the plug (see e.g., U.S. Pat. No. 4,942,925); or (ii) pumps a ball 24 down to the uppermost flapper assembly 20. Where ball 24 is deployed, flow tube 22 is first in the position shown in FIGS. 2B, 2C; where it is held by pin 30, which is threaded into at least one side of the portion of hole 32 extending through outer housing 34 of flapper assembly 20. In this position, internal housing 36 with flapper is held in position in a section of outer housing 34 having a larger ID than the remainder of center bore 54, as illustrated. When positioned as shown in FIGS. 2B, 2C, flow tube 22 holds open flapper 26. FIG. 2D shows that flow tube 22 has been shifted down by ball 24, shearing pin 30 (but leaving sections intact, including the portions within the threaded portion of hole 32 in outer housing 34). FIG. 2D shows that flapper 26 has been sprung shut by spring 28—indicating that pumping pressurization has ceased.

The setting of the plug in a profile nipple, or closing of flapper 26, seals the portions of the string below the plug or flapper 26, and allows one to regain well control. One then pulls up the string to the section where the plug or flapper assembly 20 is positioned. One then closes at least one of the DSV valves 42 and 44 (preferably both) or removes the plug (if present), and bleeds the pressure out below the flapper or plug through hole 32, by screwing out the threaded portions of pin 30 remaining in hole 32. One can then inspect, maintain, repair or replace tool 10 and the above-surface portions of the string.

Once all problems are remedied: tool 10 (if present) is attached to DSV 40, and end 21 of flapper assembly 20 (if present) is attached (with adapters, if necessary) to the upper end of tool 10; and then end 21 (or the upper end 12 of tool 10, if flapper assembly 20 is absent) is then attached to portions of the string at the surface, which are in attached to a pressurized fluid source, preferably, a pressurized mud source. Alternatively, upper end 58 of DSV 40 (if no tool 10 or flapper assembly 20 are present) is attached to the pressurizing source, and pressure is applied. Valves 42 and 44 are then opened by turning keys 46, 48, and mud is pumped down the bore through DSV 40, and also through tool 10 and flapper assembly 20 (if the latter two components are present). The string is fed back into the hole, preferably to place the s BHA at the same position where it was before pulling up commenced. Drilling can then resume.

Figure 1B:
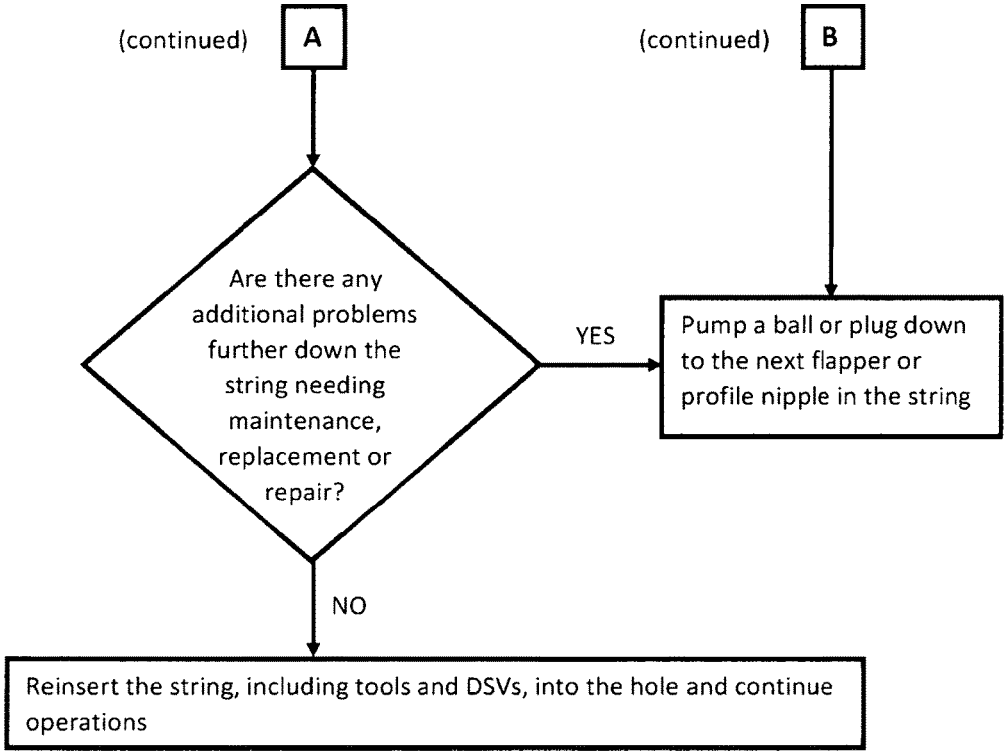

If there are problems with tools or well control further down the string, which are observed after the uppermost DSV 40 is at the surface, then: upper end 58 of DSV 40 is attached to the pressurized fluid source; next, valves 42 and 44 are opened by turning keys 46, 48, and a ball 24 or a plug are pumped down the string, until reaching, respectively, the next flapper assembly 20 or the next profile nipple in the string. The remainder of the process described above can be repeated (as shown in FIGS. 1A, 1B) as many times as needed, until all defects are remedied and all needed maintenance is performed.

It can be seen that the greater the number of DSVs positioned along the string—in the event of loss of well control, the greater the likelihood that one can avoid tripping the entire string and the greater the likelihood that a shorter string length, than in a string without any DSVs, will need to be withdrawn—provided that the probability of problems/defects at all points along the string is approximately the same. Having the DSVs associated with each tool along the string allows one to avoid tripping the entire string to repair, maintain or replace a particular tool. The ability to avoid running a wire line and tripping the string by deploying DSVs along the string provides substantial cost savings. Each added DSV in a string provides a proportionally increased likelihood of greater cost savings—again, assuming that the probability of problems/defects at all points along the string is approximately the same.

The DSV 40 is depicted as including two ball valves 42, 44, but a greater or lesser number of valves could be used, and valves other than ball valves could be used. The only conditions for the DSV is that it must be readily opened and closed once at the surface, and it should also have an inner diameter larger than the plug's outer diameter (so the plug can be passed through it). Other types of valves which can be closed from the surface can be deployed instead of flapper assembly 20.

It is understood that the foregoing figures, descriptions and embodiments are intended to merely exemplify and illustrate but not limit the scope of the invention. Other embodiments, modifications, variations and equivalents of the invention will be apparent to those skilled in the art and are also within the scope of the invention, which is only described only in the claims which follow.

What is claimed is:

1. In a string where one or more tools are deployed upstream of the bottom hole assembly, a method of efficiently inspecting, maintaining repairing or replacing downhole string sections and/or tools, comprising:

deploying along the string at least one combination of: a means for stopping flow in the string from the surface when said means is downhole, a tool, and a downhole safety valve which can be operated to close flow along the string when the combination is at the surface;

placing the string and the combination(s) downhole, where inspection, maintenance, repair or replacement of the downhole sections of the string or any tools, is carried out by performing the following steps:

(i) operating the means for stopping flow from the surface in the combination closest to the surface;

(ii) pulling up the string to the point where the downhole safety valve in said combination can be closed, and closing said downhole safety valve;

(iii) inspecting, maintaining, repairing or replacing accessible string sections and/or the tool in said combination;

(iv) completing string and tool inspection, maintenance, repair, and/or replacement in said combination and in the accessible string sections; and either: (a) reversing said means for stopping flow to allow flow, and opening said downhole safety valve, and inserting the string portions which were pulled up back into the hole; or, (b) if there are additional combinations downhole, then opening said downhole safety valve and repeating steps (i) to (iv) for the combination next closest to the surface if string sections or combinations which remain downhole appear to need inspecting, maintaining, repairing or replacing.

2. The method of claim 1 wherein the means for stopping flow is a plug which is pumped downhole to a profile nipple where it sets, or a flapper valve assembly which is closed by pumping a ball downhole.

3. The method of claim 2 wherein the flapper valve assembly includes a spring loaded valve held open by a flow tube which has an axial bore contiguous with the central bore in the flapper valve assembly.

4. The method of claim 3 wherein the flow tube is attached to a flapper assembly housing with a pin, which is sheared when the ball is pumped down to shift the flow tube.

5. The method of claim 1 further including the step of bleeding off the pressure below plug or flapper after closing said downhole safety valve.

6. The method of claim 1 wherein the downhole safety valve includes two valves which are independently capable of closing flow along the string.

7. The method of claim 6 wherein the two valves are ball valves, which are turned to close and open them.

8. The method of claim 1 wherein the tool is a jar, a shock absorbing tool, a well bore cleaning tool, a logging tool, a fluid bypass tool or an extended reach tool.

9. The method of claim 1 wherein step (iv) (b) is repeated at least twice and at least three of said combinations are pulled to the surface.

10. The method of claim 1 wherein the string consists of sections of pipe or coil tubing.

11. In a string where one or more tools are deployed upstream of the bottom hole assembly, a method of efficiently inspecting, maintaining repairing or replacing downhole string sections and/or tools, comprising:

deploying along the string at least one combination of: a valve or profile nipple which can be operated from the surface to stop flow in the string when the combination is downhole, a tool, and a downhole safety valve which can be operated to close flow along the string when the combination is at the surface;

placing the string and the combination(s) downhole, where inspection, maintenance, repair or replacement of the downhole sections of the string or any tools, is carried out by performing the following steps:

(i) closing the valve or setting a plug in the profile nipple from the surface in the combination closest to the surface;

(ii) pulling up the string to the point where the downhole safety valve in said combination can be closed, and closing said downhole safety valve;

(iii) inspecting, maintaining, repairing or replacing accessible string sections and/or the tool in said combination;

(iv) completing string and tool inspection, maintenance, repair, and/or replacement in said combination and in the accessible string sections; and either: (a) removing the plug or opening said valve, and opening said downhole safety valve, and inserting the string portions which were pulled up back into the hole; or, (b) if there are additional combinations downhole, then opening said downhole safety valve and repeating steps (i) to (iv) for the combination next closest to the surface if string sections or combinations which remain downhole appear to need inspecting, maintaining, repairing or replacing.

12. The method of claim 11 wherein the profile nipple stops flow when a plug is pumped downhole to the profile nipple where it sets.

13. The method of claim 11 wherein the valve is a spring-loaded flapper valve assembly which is closed by pumping a ball downhole.

14. The method of claim 13 further including the step of bleeding off pressure below the valve after closing said downhole safety valve by unscrewing a section of a pin extending through the flapper valve assembly.

15. The method of claim 11 wherein the downhole safety valve includes two valves which are independently capable of closing flow along the string.

16. The method of claim 15 wherein the two valves are ball valves, which are turned to close and open them.

17. A process of minimizing the string sections pulled up to inspect, maintain, repair or replace the string or one or more tools deployed along the string, comprising:

deploying, along the string, at least one combination of: a means for stopping flow in the string from the surface when said means is downhole, and a downhole safety valve which can be operated to close flow along the string when the combination is at the surface;

placing the string and the combination(s) downhole, whereby one can inspect, maintain, repair or replace the downhole sections of the string or any tools, la performing the following steps:

(i) operating the means for stopping flow from the surface in the combination closest to the surface;

(ii) pulling up the string to the point where the downhole safety valve in said combination can be closed, and closing said downhole safety valve;

(iii) inspecting, maintaining, repairing or replacing accessible string sections or tools;

(iv) completing string and tool inspection, maintenance, repair, and/or replacement in the accessible string sections; and either: (a) reversing the means for stopping flow to allow flow, opening said downhole safety valve, and inserting the string portions which were pulled up back into the hole; or, (b) only if there are additional string sections or tools which remain downhole which need inspecting, maintaining, repairing or replacing, then opening said downhole safety valve and repeating steps (i) to (iv) for the combination next closest to the surface.

18. The method of claim 17 wherein the string is attached to a source of pressurized mud or fluid at the surface, and the string is pressurized, before opening the downhole safety valve in step (iv).

19. The method of claim 17 wherein the means for stopping flow is a plug which is pumped downhole to a profile nipple where it sets, or a flapper valve assembly which is closed by pumping a ball downhole.

20. The method of claim 17 wherein each combination includes a tool between the means for stopping flow and the downhole safety valve.

* * * * *